US006250453B1

(12) United States Patent
Furuya

(10) Patent No.: US 6,250,453 B1
(45) Date of Patent: Jun. 26, 2001

(54) METHOD AND DEVICE FOR DETECTING COIN

(75) Inventor: Yonezo Furuya, Saitama (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/424,022

(22) PCT Filed: Mar. 10, 1999

(86) PCT No.: PCT/JP99/01174

§ 371 Date: Nov. 17, 1999

§ 102(e) Date: Nov. 17, 1999

(87) PCT Pub. No.: WO99/48059

PCT Pub. Date: Sep. 23, 1999

(30) Foreign Application Priority Data

Mar. 17, 1998 (JP) ..... 10-067022
Apr. 30, 1998 (JP) ..... 10-120683

(51) Int. Cl.[7] ..... G07D 5/08
(52) U.S. Cl. ..... 194/317
(58) Field of Search ..... 453/17; 194/317, 194/318, 319, 324

(56) References Cited

U.S. PATENT DOCUMENTS 3,749,220 * 7/1973 Tabiichi et al. ..... 194/319
4,754,862 * 7/1988 Rawicz-Szczerbo et al. ..... 194/319
5,158,166 * 10/1992 Barson ..... 194/319
5,947,257 * 9/1999 Schwartz ..... 194/224

FOREIGN PATENT DOCUMENTS 3-282695 12/1991 (JP) .
4-205489 7/1992 (JP) .
4-507469 12/1992 (JP) .

* cited by examiner

*Primary Examiner*—Robert P. Olszewski
*Assistant Examiner*—Bryan Jaketic
(74) *Attorney, Agent, or Firm*—Hogan & Hartson, LLP

(57) ABSTRACT

A method and device for detecting a coin, wherein one of a plurality of coils (1*a*, 1*b*, 1*c*) is selectively connected to an oscillation unit (4) via a switching unit (2) and a coin is detected based on an output from an oscillation circuit comprising the connected coil (one of 1*a*, 1*b*, 1*c*) and the oscillation unit (4).

20 Claims, 12 Drawing Sheets

METHOD AND DEVICE FOR DETECTING COIN

TECHNICAL FIELD

The present invention relates to a method and a device for detecting a coin, and more particularly to a method and a device for detecting a coin which can detect the existence of a coin in vending machines, game machines and the like by a simple structure without making any adjustment.

BACKGROUND ART

Vending machines, game machines and the like are provided with a device for detecting the presence of coins (including not only coins used as money but also coin-type tokens for game machines, etc.). This device is used for example to detect the existence of coins in a cylinder for storing change in a coin processor of a vending machine, and the detection by the device is made by various methods.

The method of detecting a coin includes an optical method as disclosed in the U.S. Pat. No. 4,413,718. This method uses a light emitting device and a photodetector which are mounted in the neighborhood of a coin-storing cylinder and detects that light is blocked by the coins stored in the cylinder.

Another method detects the existence of a coin by a proximity switch which has a coil as disclosed in the U.S. Pat. No. 4,460,003.

Now, detection of the presence of change by a coil in the coin processor used for the vending machine or the like will be described.

FIG. 12 is front diagram schematically showing coin processor.

In FIG. 12, a coin processor 560 has a coin insertion port 561 for receiving a coin 531, coin passages 562 (562*a* to 562*d*) for rolling and transporting the coin 531 inserted from the coin insertion port 561, a coin inspection unit 563 located near the coin passage 562*a* for judging whether the coin passing through the coin passage 562*a* is real or not and its money type, a dividing unit 564 for guiding a counterfeit coin from a counterfeit coin passage (not shown) to a return port (not shown) based on the judgement made by the coin inspection unit 563 and guiding a true coin to one of the coin passages 562*b* to 562*d* according to its money type, and a coin storing unit 530 for storing coins according to their money types.

The coin storing unit 530 comprises three cylinders 530*a* to 530*c* so that a maximum of three types of coins can be stored. The cylinders 530*a* to 530*c* are provided with coils 501*a* to 501*c* respectively.

FIG. 13 is a cross sectional view taken along line A–A' of the coin processor 560 shown in FIG. 12.

As shown in FIG. 13, the coils 501*a* to 501*c* are arranged in the neighborhood of the cylinders 530*a* to 530*c* respectively to detect the presence of coins in the cylinders when the number of coins is at least a predetermined number.

FIG. 14 is a diagram showing a circuit structure for detecting the presence of coins by means of the coils 501*a* to 501*c*.

The coil 501*a* (L51) is connected with an oscillation unit 504*a* as shown in FIG. 14 and then with a comparison judgment circuit 507*a* and a reference value circuit 508*a* via the oscillation unit 504*a*. In the same manner, the coil 501*b* (L52) is connected with an oscillation unit 504*b* and then with a comparison judgment circuit 507*b* and a reference value circuit 508*b* via the oscillation unit 504*b*. Coil 501*c* (L53) is connected with an oscillation unit 504*c* and then with a comparison judgment circuit 507*c* and a reference value circuit 508*c* via the oscillation unit 504*c*.

In the configuration described above, the coil 501*a* (501*b*, 501*c*) is excited at a fixed frequency by the operation of the oscillation unit 504*a* (504*b*, 504*c*). When a coin approaches the coil 501*a* (501*b*, 501*c*), an inductance L1 (L2, L3) of the coil changes (including changes of impedance ($R+j\omega L$) and $Q(\omega L/R)$), resulting in varying an oscillation frequency. The comparison judgment circuit 507*a* (507*b*, 507*c*) compares the oscillation frequency with a reference value generated by the reference value circuit 508*a* (508*b*, 508*c*) to detect the presence 510*a* (510*b*, 510*c*) of the coin.

Of the above-mentioned conventional technologies, the optical type can be configured relatively easily but has a drawback that, for example, dust or the like adheres to cause malfunction.

Meanwhile, the one using a coil is extensively used because it is resistant against dust or the like. But, an inspection circuit which contains the oscillation circuit and the like is needed for each coil and becomes complex. Besides, it is necessary to differentiate the oscillation frequency of each circuit to avoid the interference between the coils. It is also necessary to make the temperature compensation of the inspection circuits individually because the oscillation frequency is different in each inspection circuit.

Thus, in the conventional technology using the coil, two or more inspection circuits are necessary and such circuits must be adjusted individually. Therefore, the circuits become complex, and the number of parts increases. And the manufacture and adjustment of the circuits become complex and expensive.

DISCLOSURE OF THE INVENTION

It is an object of the invention to provide a method and a device for detecting a coin, which can be achieved by a simple circuit structure which has no interference between circuits and excels in extendibility.

In order to achieve the above-described object, the invention of claim 1 is a method of detecting a coin, which comprises steps of:

arranging coils corresponding to a plurality of coin detecting positions;

selectively connecting the plurality of coils to an oscillation circuit which has the coils as circuit structure elements; and detecting coins to be detected at the plurality of coin detecting positions in view of a change in oscillation output from the oscillation circuit as the coins to be detected approach the coils.

The invention of claim 2 relates to the invention according to claim 1, wherein the plurality of coils are sequentially switched to connect to the oscillation circuit.

The invention of claim 3 relates to the invention according to claim 1, wherein the oscillation output is converted into a digital signal, the converted digital signal is compared with a predetermined value, and the coins to be detected are detected based on the comparison result.

The invention of claim 4 relates to the invention according to claim 3, wherein the predetermined value is switched according to the coil-to be connected.

The invention of claim 5 relates to the invention according to claim 1, wherein the change in the oscillation output is a change in the output level of the oscillation circuit.

The invention of claim 6 relates to the invention according to claim 1, wherein the change in the oscillation output is a stop of the oscillation of the oscillation circuit.

The invention of claim 7 relates to the invention according to claim 1, wherein the oscillation circuit has a positive feedback type amplifier and a capacitor and oscillates by connecting the coil with the capacitor in parallel, and the frequency of the oscillation is a resonance frequency of the oscillation circuit.

The invention of claim 8 relates to the invention according to claim 1, wherein the oscillation circuit comprises an amplifier which has positive feedback with a resistor and a first capacitor connected in series and a second capacitor and oscillates by connecting the coil to the second capacitor in parallel, and the frequency of the oscillation is a frequency based on an amplification factor of the amplifier and a resonance frequency of the positive feedback and the oscillation circuit.

The invention of claim 9 relates to the invention according to claim 1, wherein the coil is arranged together with the capacitor connected to the coil in parallel, and the coil and the capacitor are selectively connected with the oscillation circuit.

The invention of claim 10 relates to the invention according to any of claims 1 to 9, wherein the coil is wound around a core having a magnetic core, and the core is protruded from the coil.

The invention of claim 11 relates to the invention according to claim 10, wherein the coil is housed together with the core in a predetermined casing.

The invention of claim 12 is a coin detecting device, which comprises:

a plurality of coils arranged to correspond with a plurality of coin detecting positions;

an oscillation circuit which selectively has one of the plurality of coils as a circuit structure element;

switching means to selectively connect the plurality of coils to the oscillation circuit; and detection means for detecting coins to be detected at the plurality of coin detecting positions in view of a change in an oscillation output of the oscillation circuit as the coins to be detected approach the coils.

The invention of claim 13 relates to the invention according to claim 12, wherein the switching means sequentially switches the plurality of coils to connect to the oscillation circuit.

The invention of claim 14 relates to the invention according to claim 12, wherein the detection means comprises:

digital conversion means for converting the output from the oscillation circuit into a digital signal;

storage means for storing a fixed value; and comparison means for comparing a value of the digital signal converted by the digital conversion means with the fixed value stored in the storage means.

The invention of claim 15 relates to the invention according to claim 14, wherein the storage means outputs the fixed value corresponding to the coil connected by the switching means to the comparison means.

The invention of claim 16 relates to the invention according to claim 12, wherein the detection means detects a change in an output level of the oscillation circuit.

The invention of claim 17 relates to the invention according to claim 12, wherein the detection means detects that the oscillation circuit has stopped oscillating.

The invention of claim 18 relates to the invention according to claim 12, wherein the oscillation circuit has a positive feedback type amplifier and a capacitor and oscillates when the coil is connected with the capacitor in parallel.

The invention of claim 19 relates to the invention according to claim 12, wherein the oscillation circuit comprises an amplifier which has positive feedback with a resistor and a first capacitor connected in series and a second capacitor, and oscillates when the coil is connected to the second capacitor in parallel.

The invention of claim 20 relates to the invention according to claim 12, wherein the coil is arranged together with a capacitor which is connected to the coil in parallel, and the switching means selectively connects the coil together with the capacitor to the oscillation circuit.

The invention of claim 21 relates to the invention according to any of claims 12 to 20, wherein the coil is wound around a core having a magnetic core, and the core is protruded from the coil.

The invention of claim 22 relates to the invention according to claim 21, wherein the coil is housed together with the core in a predetermined casing.

BEST MODE FOR CARRYING OUT THE INVENTION

One embodiment of a method and a device for detecting a coin according to the invention will be described in detail with reference to the accompanying drawings.

Figure 1:
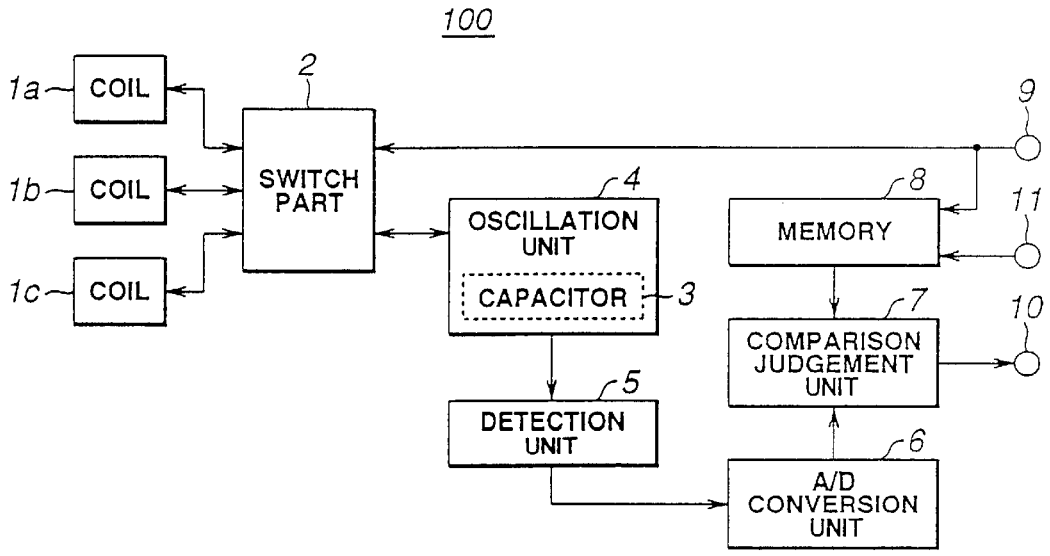
FIG. 1 is a block diagram schematically showing the structure of a coin detecting device.

FIG. 1 is a block diagram showing a schematic structure of a coin detecting device.

Coin detecting device 100 comprises coils 1 (1*a* to 1*c*), switching unit 2, oscillation unit 4 including capacitor 3, detection unit 5, A/D conversion unit 6, comparison judgment unit 7, memory 8, input terminal 9, output terminal 10, and input terminal 11.

In the coin detecting device 100, the coils 1 are connected in parallel with the capacitor 3 of the oscillation unit 4 via the switching unit 2. The switching unit 2 connects any one of the coils 1*a* to 1*c* to the capacitor 3 according to a changeover signal which is sent from a control (not shown) and input through the input terminal 9. Coil 1 (one of 1*a* to 1*c*) connected with the capacitor 3 through the switching unit 2 configures an oscillation circuit, which has the oscillation unit 4, the coil 1 and the capacitor 3 as the circuit structure elements. The oscillation unit 4 configured as described above, when the coil 1 does not act on the coin electromagnetically, continues to oscillate at the resonance frequency of coil 1 and capacitor 3 based on a predetermined oscillation condition and outputs a fixed AC voltage signal. On the other hand, when coil 1 acts enough on the coin, the output of the oscillation unit 4 changes for the reasons described afterward.

Therefore, the output (AC voltage signal) of the oscillation unit 4 is converted by the detection unit 5 into the DC voltage signal which corresponds to the output of the oscillation unit. The DC voltage signal is converted into a digital signal by the A/D conversion unit 6. This digital signal is compared with a fixed value stored in the memory 8 by the comparison judgment unit 7 to judge the presence or not of the coin, and the judgment result is output from the output terminal 10.

The memory 8 selects a fixed value to be output to the comparison judgment unit 7 according to the changeover signal to be input in the switching unit 2 and can set the fixed value to an arbitrary value via the input terminal 11.

Figure 2:
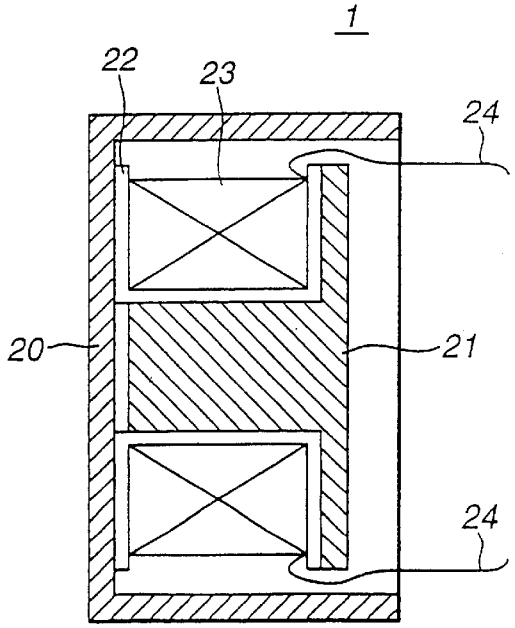
FIG. 2 is a diagram showing the structure of coil 1.

FIG. 2 is a diagram showing a structure of the coil 1.

The coil 1 comprises T-type ferrite core 21, bobbin 22 fitted to the ferrite core 21 and coil 23 wound around bobbin 22 and is connected to the switching unit 2 or the capacitor 3 through lead 24.

Each unit which composes the coil 1 can be mounted on casing 20 according to a technical demand for an environmental resistance and the like.

Figure 3:
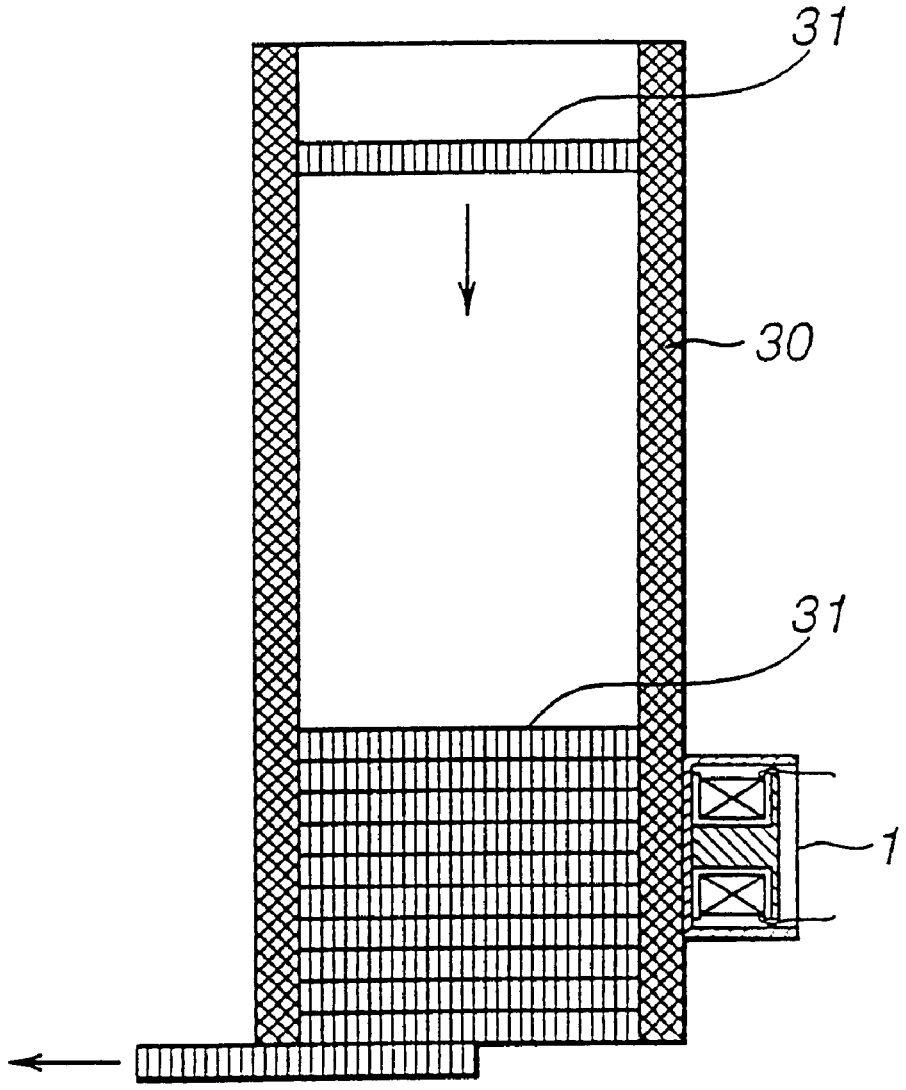
FIG. 3 is a diagram showing an example of arranging coil 1.
Figure 12:
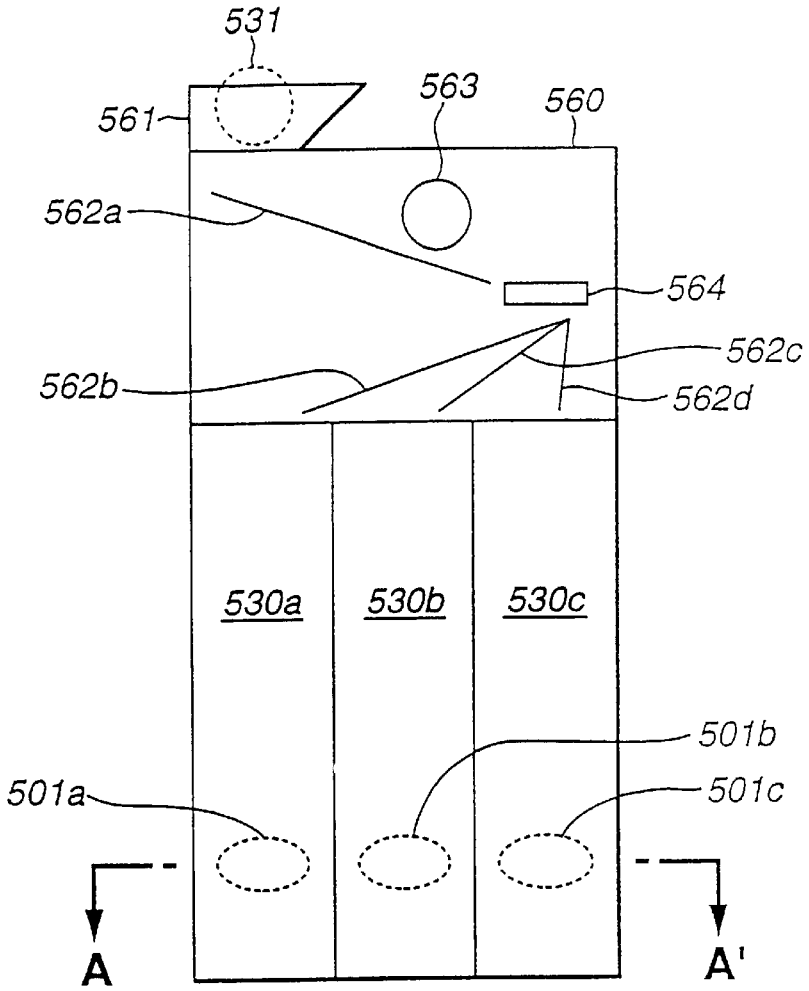
FIG. 12 is a front elevation schematically showing the coin processor.
Figure 13:
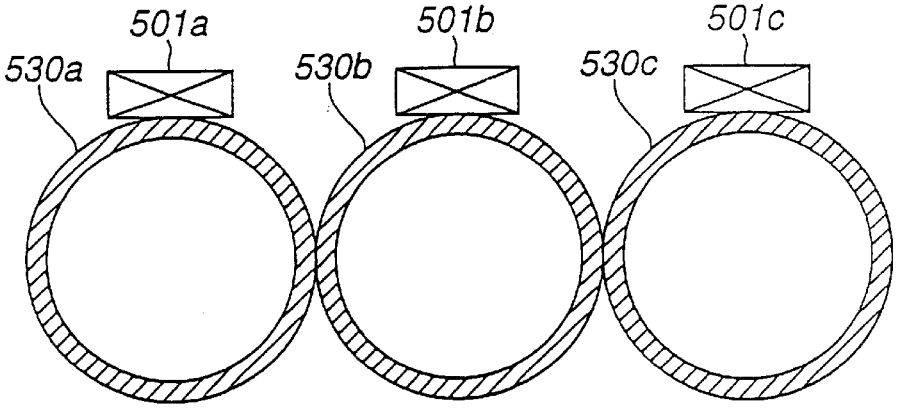
FIG. 13 is a cross sectional view taken along line A–A' of coin processor 560.
Figure 14:
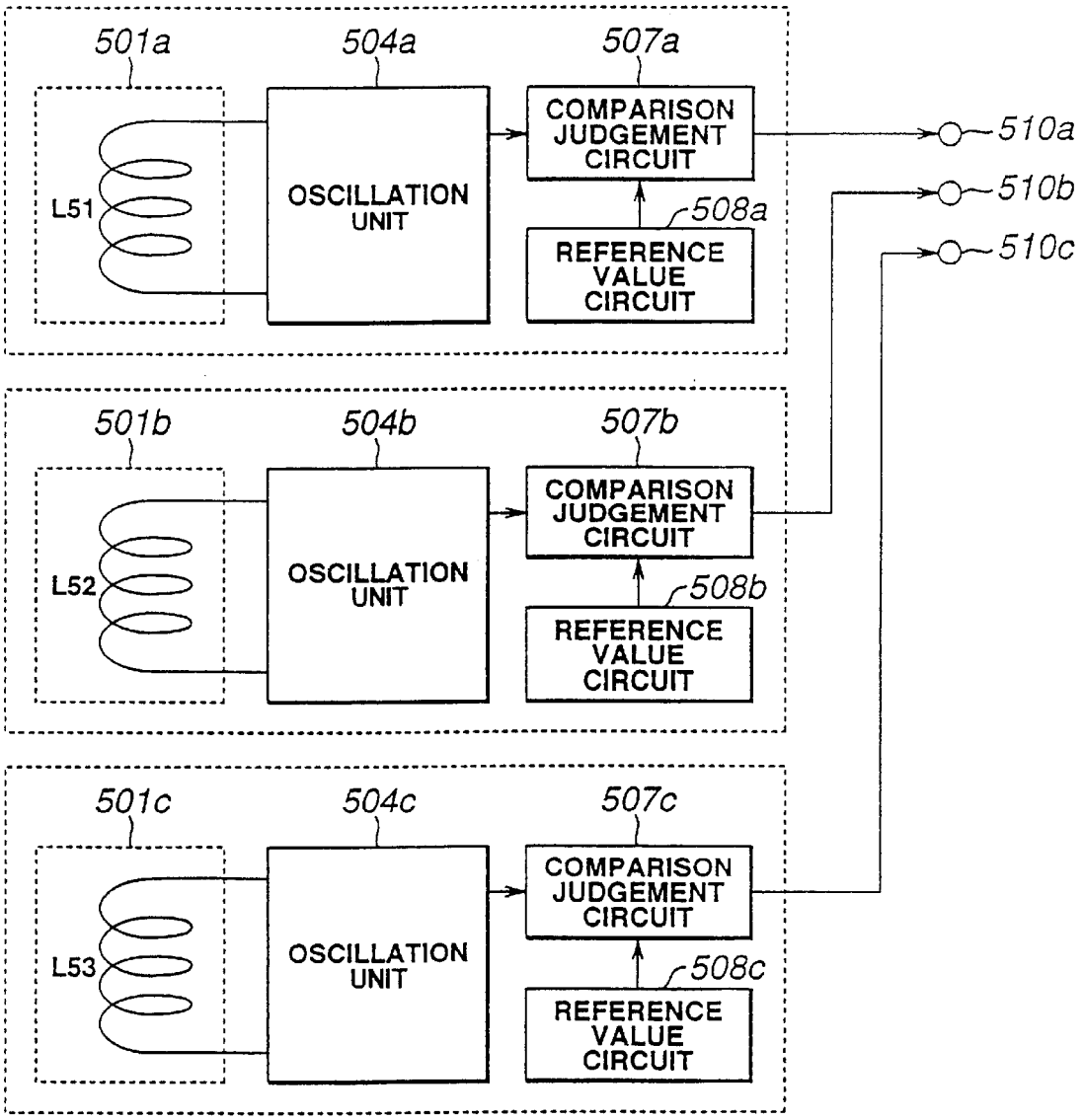
FIG. 14 is a diagram showing a circuit structure for detecting the presence of a coin by means of coils 501*a* to 501*c*.

For instance, as shown in FIG. 3, the coil 1 is disposed in the neighborhood of coin storing unit 30 (corresponding to coin storing unit 530 of FIG. 12 described in BACKGROUND ART) and detects that coins 31 more than a predetermined number are piled up in coin storing unit 30.

The structure of coin detecting device 100 shown in FIG. 1 will be described in detail with reference to FIG. 4.

Figure 4:
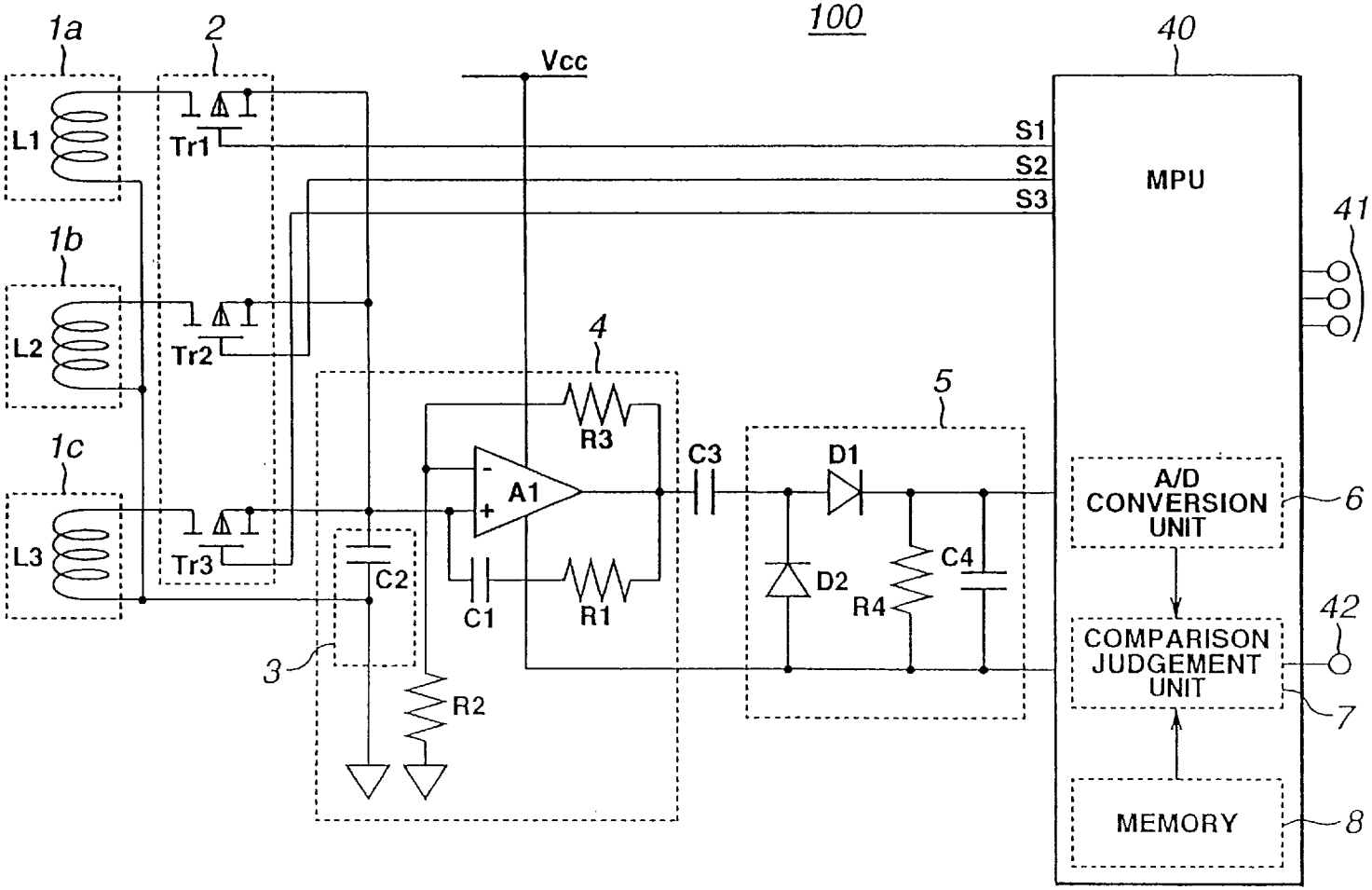
FIG. 4 is a diagram showing an example of the circuit for achieving coin detecting device 100 shown in FIG. 1.

FIG. 4 is a diagram showing an example of circuit to achieve the coin detecting device 100 shown in FIG. 1.

In the circuit shown in FIG. 4, coils 1*a* to 1*c* have inductances configured of coils L1, L2, L3 (Li=L2=L3) respectively. And, switching unit 2 for selectively switching the coils 1*a* to 1*c* comprises P channel MOS-type FETs Tr1, Tr2, Tr3. The capacitor 3 is a capacitor having electrostatic capacity C2. Oscillation unit 4 comprises operation amplifier A1 connected so that the coil 1 (any of 1*a* to 1*c*) is connected in parallel to the capacitor 3 via the switching unit 2 so to form an oscillation circuit, a CR series circuit of resistor R1 and the capacitor C1 connected to form a positive feedback circuit of the operation amplifier A1, and resistors R2, R3 connected to determine gain of the operation amplifier A1. Detection unit 5 comprises a voltage doubler rectifier circuit of diodes D1, D2 and an integrating circuit of resistor R4 and capacitor C4. A/D conversion unit 6, comparison judgment unit 7 and memory 8 comprise MPU (microprocessor unit) 40 to which interface terminal 41 and output terminal 42 are connected.

The switching unit 2 makes switching to selectively connect one of coils 1*a*, 1*b*, 1*c* to capacitor 3 in oscillation unit 4. This switching operation is effected with the gate voltage of the MOS-type FETs (Tr1, Tr2, Tr3) controlled by switch signals S1, S2, S3 output from MPU 40.

Now, operation of the oscillation unit 4 will be described.

Figure 5:
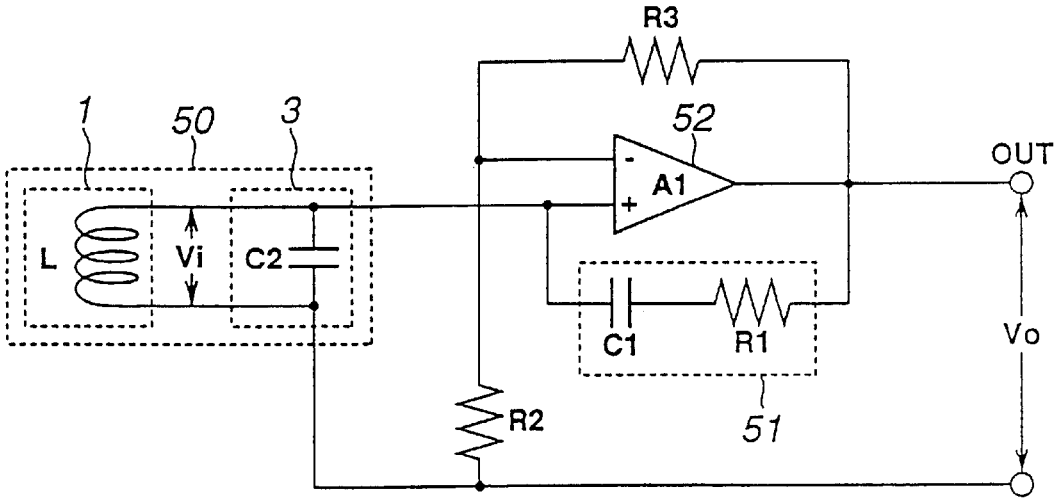
FIG. 5 is a circuit diagram to illustrate oscillation unit 4.

FIG. 5 is a circuit diagram for illustrating oscillation unit 4.

Oscillation unit 4, when coil 1 does not detect a coin, oscillates at a fixed frequency and when coil 1 detects a coin, its output level changes (the oscillation may stop occasionally).

When it is assumed that impedance of positive feedback circuit 51 (series circuit of capacitor C1 and resistor R1) of operation amplifier 52 (A1) is Z1 and impedance of parallel circuit 50 of coil 1 (inductance L) and capacitor 3 (electrostatic capacity C2) is Z2, Z1 and Z2 are expressed respectively by the expression (1) and the expression (2).

$$Z1 = R1 - j\frac{1}{\omega C1} \tag{1}$$

$$Z2 = \frac{1}{\frac{1}{j\omega L} + \frac{1}{\frac{1}{j\omega C2}}} = \frac{j\omega L \times \left(-j\frac{1}{\omega C2}\right)}{j\omega L - j\frac{1}{\omega C2}} \tag{2}$$

When it is assumed that a current flowing the circuit is i, a ratio of input voltage Vi, output voltage Vo and I/O voltage is expressed by the expression (3).

$$\begin{aligned} Vo &= (Z1 + Z2) \\ Vi &= Z2 \times i \\ \frac{Vo}{Vi} &= \frac{Z1 + Z2}{Z2} \\ &= 1 + \frac{Z1}{Z2} \\ &= 1 + \frac{R1 - j\frac{1}{\omega C1}}{\frac{j\omega L \times \left(-j\frac{1}{\omega C2}\right)}{j\omega L - j\frac{1}{\omega C2}}} \\ &= \left(1 + \frac{C2}{C1} + \frac{1}{\omega^2 C1 \times L}\right) + j\left(\omega C2 \times R1 - \frac{R1}{\omega L}\right) \end{aligned} \tag{3}$$

Here, input voltage Vi and output voltage Vo become in phase because the feedback circuit of operation amplifier 52 is a positive feedback circuit. Therefore, imaginary number part in the expression (3) is zero, leading to the expression (4). Accordingly, oscillation frequency f0 of oscillation unit 4 is expressed by the expression (5).

$$\omega C2 \times R1 - \frac{R1}{\omega L} = 0 \tag{4}$$

$$\omega^2 = \frac{1}{C2 \times L}$$

$$\therefore\ \omega = \frac{1}{\sqrt{C2 \times L}}$$

$$f0 = \frac{1}{2\pi\sqrt{C2 \times L}} \tag{5}$$

When oscillation frequency f0 is shown by the expression (5), the relation between input voltage Vi and output voltage Vo is expressed by the expression (6). Oscillation condition to continue the oscillation is expressed by the expression (7) because Vo/Vi indicates voltage amplification Av of the amplification circuit.

$$\frac{Vo}{Vi} = 1 + \frac{C2}{C1} + \frac{1}{\omega^2 C1 \times L} \tag{6}$$

$$Av \geq 1 + \frac{C2}{C1} + \frac{1}{\omega^2 C1 \times L} + j\left(\omega C2 \times R1 - \frac{R1}{\omega L}\right) \tag{7}$$

Oscillation unit 4 continues oscillating while the expression (7) is held, and an AC voltage signal of sine wave is output at the output of oscillation unit 4. In an actual circuit, the value of each unit is adjusted to fulfill the expression (7) in a state that coil 1 does not make a mutual electromagnetic reaction with the coin.

In oscillation unit 4 well adjusted as described above, coil 1 reacts electromagnetically with the coin, namely, permeability is changed because the coin exists in the neighborhood of coil 1, the value of inductance L changes into L', and the condition shown by the expression (8) is established to terminate oscillation.

$$Av < 1 + \frac{C2}{C1} + \frac{1}{\omega^2 C1 \times L'} + j\left(\omega C2 \times R1 - \frac{R1}{\omega L'}\right) \tag{8}$$

Output (AC voltage signal) of oscillation unit 4 is input to detection unit 5 and detected and rectified by diodes D1 and D2, then converted into a DC voltage signal by an integrating circuit composed of resistor R4 and capacitor C4. This DC voltage signal is converted into a digital signal in A/D conversion unit 6 and compared in comparison judgment unit 7 with a given value stored in memory 8.

Comparison with a fixed value in comparison judgment unit 7 is not to detect only the termination of oscillation described above but to detect a change in output level (even the voltage level and the frequency are acceptable) of the oscillation unit 4 from a change in inductance L (including a change of impedance and Q involved) since coil 1 and the coin act electromagnetically. And, each part of the oscillation unit 4 is easily adjusted as compared with the case that the termination of the oscillation only is detected.

Comparison judgment unit 7 outputs a signal, which indicates that the coins of more than the fixed number are in the coin storing unit 30 (see FIG. 3), from output terminal 42 when a value of the digital signal input from A/D conversion unit 6 is smaller than the fixed value stored in memory 8.

Memory 8 can rewrite a given value stored in it by an external device (not shown) connected to interface terminal 41 of MPU 40 and also stores a plurality of given values at the same time, so that it can switch values to be output to comparison judgment unit 7 based on switch signals S1, S2, S3 which are output by MPU 40 to select one of coils 1*a*, 1*b*, 1*c*. Values output to comparison judgment unit 7 are switched for each coil because effects on inductance and Q of the coils are variable depending on the types of coins (material and thickness) detected by coils 1*a* to 1*c*.

Figure 6:
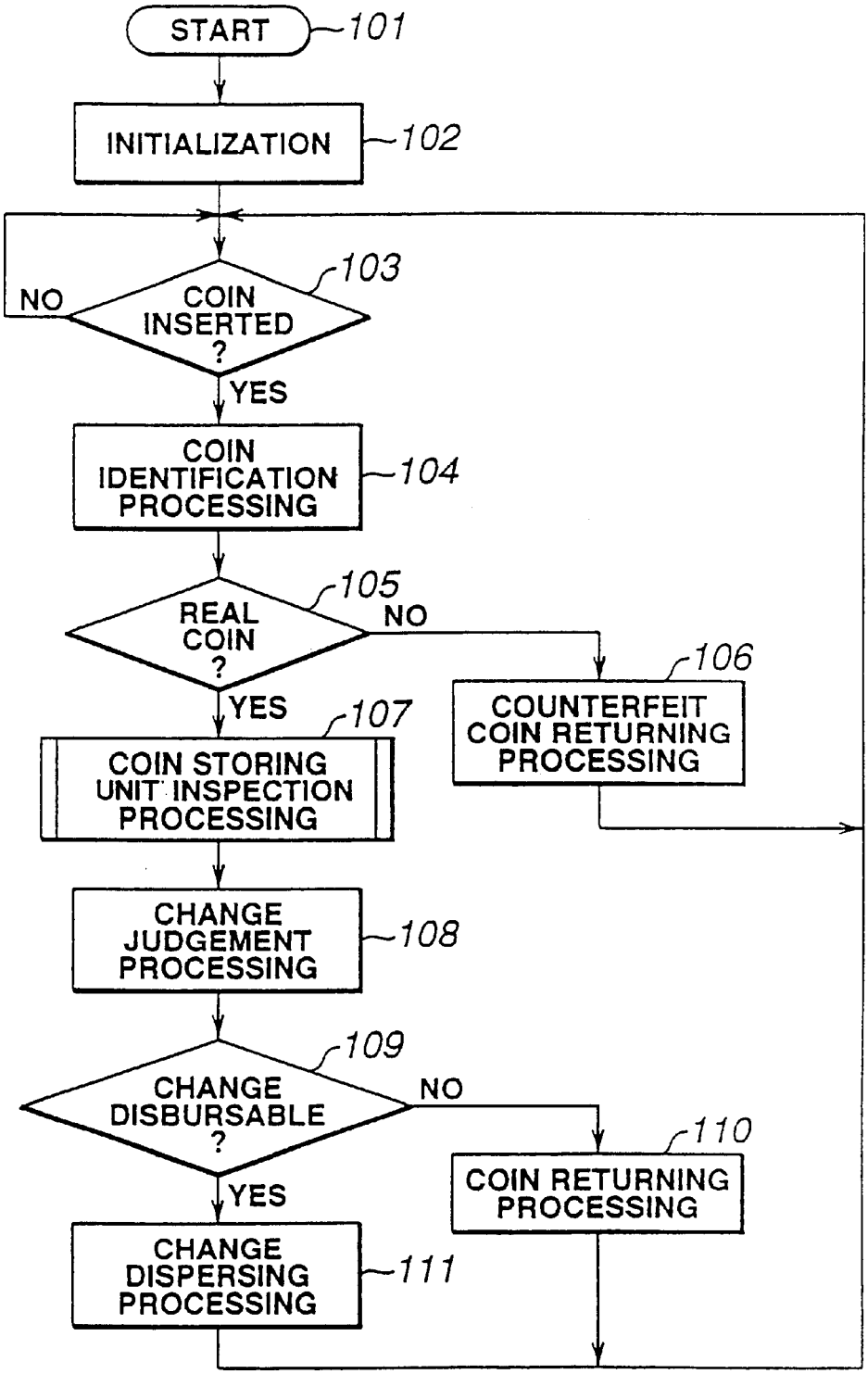
FIG. 6 is a flowchart showing the operation of the coin processor to which coin detecting device 100 is applied.
Figure 7:
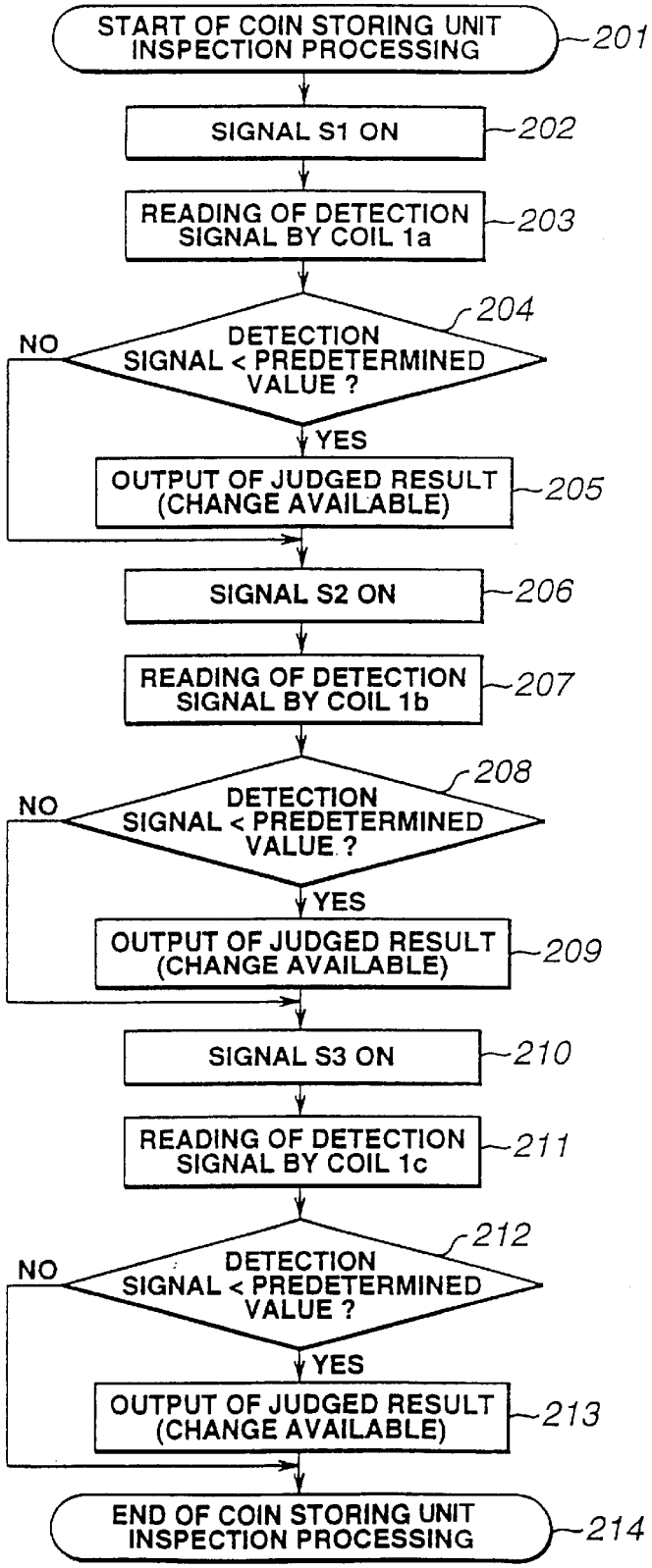
FIG. 7 is a flowchart showing a process of the coin detection.

Referring to FIG. 6 and FIG. 7, a process of the coin detection by coin detecting device 100 shown in FIG. 1 will be described.

FIG. 6 is a flowchart showing a process of the operation of the coin processor to which the coin detecting device 100 is applied. FIG. 7 is a flowchart showing a process of the coin detection.

A coin processor (not shown) installed in an automatic vending machine starts to operate when power supply is turned on (step 101), and input, output and the like of MPU are initialized (step 102). When the initialization is completed, the coin processor stands by until a coin or coins are inserted into the vending machine (NO in step 103). When a coin is inserted (YES in step 103), identification processing is performed to judge true or not and money type of the inserted coin (step 104).

When the inserted coin is judged as counterfeit money by the coin identification processing in step 104 (NO in step 105), this coin is returned as the counterfeit money (step 106). If it is judged as true money (YES in step 105), coin storing unit inspection processing is performed (step 107).

Coin storing unit inspection processing will be described below.

Coin storing unit inspection processing is to detect whether the coin storing unit contains coins to be paid out as change. The presence of coins is detected by coin detecting device 100 shown in FIG. 1. When coin detecting device 100 starts coin storing unit inspection processing (step 201), MPU 40 turns on switch signal S1 (step 202). When switch signal S1 is turned on, switching unit 2 connects coil 1*a* with oscillation unit 4. The output of oscillation unit 4 is converted into a digital detection signal by detection unit 5 and A/D conversion unit 6 (step 203). Comparison judgment unit 7 compares a value of the detection signal with a fixed value stored in memory 8 (step 204). When the value of the detection signal is smaller than the fixed value (YES in step 204), a signal indicating that the pertinent money type is stored more than the fixed number is output as a detected result (step 205).

MPU 40 turns on switch signal S2 (step 206), and then in the same manner as above, switching unit 2 connects coil lb to oscillation unit 4, output of oscillation unit 4 is converted into a digital detection signal by detection unit 5 and A/D conversion unit 6 (step 207). Comparison judgment unit 7 compares a value of the detection signal with a value of the fixed value stored in memory 8 (step 208), and when the value of the detection signal is smaller than the fixed value (YES in step 208), a signal indicating that the pertinent money type is stored more than the fixed number is output as a detected result (step 209).

Then, MPU 40 turns on switch signal S3 (step 210), and then in the same manner as above, switching unit 2 connects coil 1*c* to oscillation unit 4, output of oscillation unit 4 is converted into a digital detection signal by detection unit 5 and A/D conversion unit 6 (step 211). Comparison judgment unit 7 compares a value of the detection signal with a value of the fixed value stored in memory 8 (step 212), and when the value of the detection signal is smaller than the fixed value (YES in step 212), a signal indicating that the pertinent money type is stored more than the fixed number is output as a detected result (step 213). And the coin storing unit inspection processing is terminated (step 214).

When the coin storing unit inspection processing is terminated (step 107), it is judged whether change can be paid out or not based on the inspection result, the amount of money inserted, and the price of commodity (step 108). If change cannot be paid out (NO in step 109), the inserted coin is returned (step 110). But, if change can be paid out, commodity is discharged and change is paid out at the same time (step 111). Then the device stands by for the next insertion of coins (step 103).

A second embodiment of the method and device of detecting a coin according to the present invention will be described.

Figure 8:
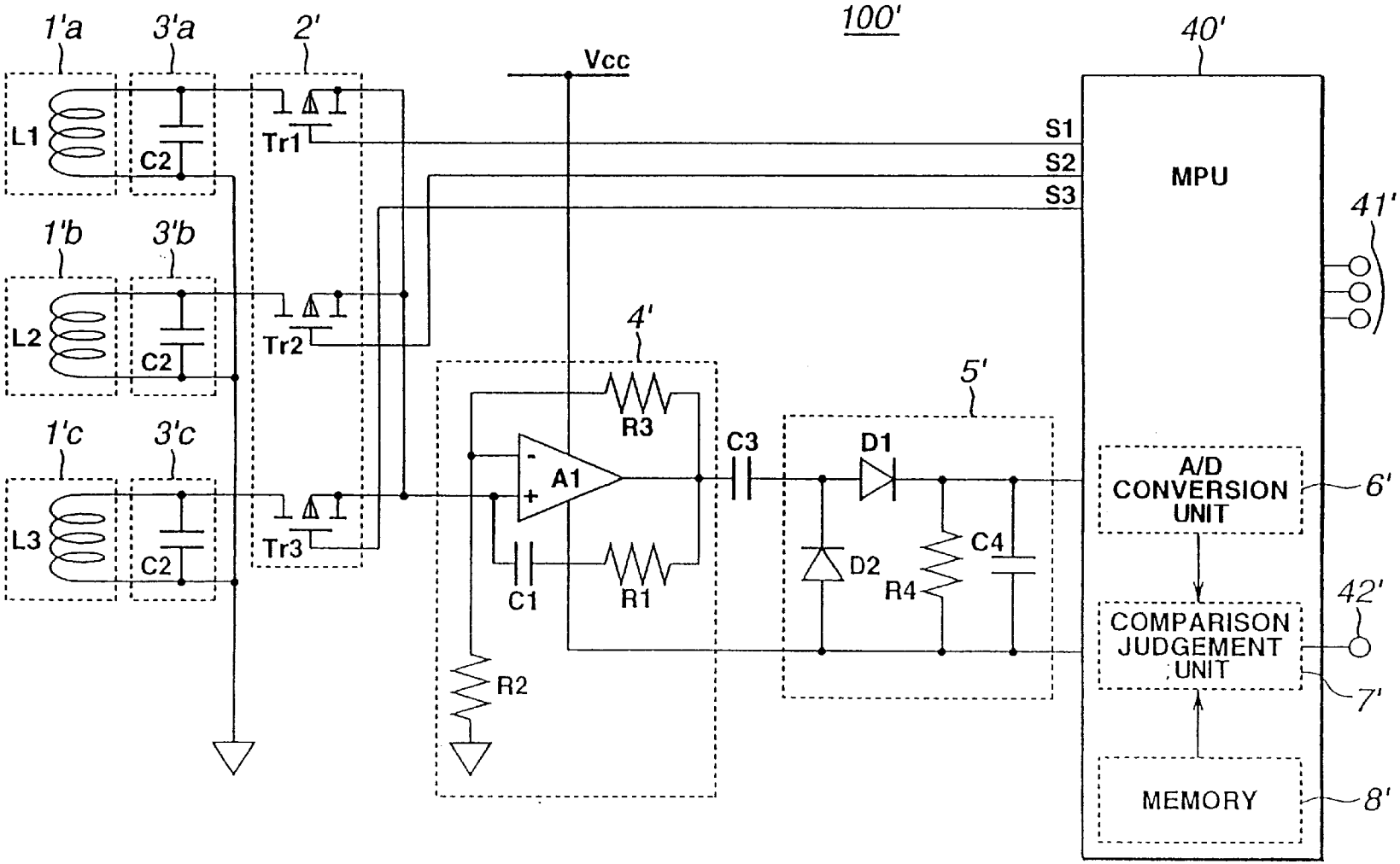
FIG. 8 is a diagram showing an example of the circuit of the coin detecting device in a second embodiment.

FIG. 8 is a diagram showing an example of the circuit of the coin detecting device in the second embodiment.

Coin detecting device 1001 comprises coils 1' (1*a* to 1'*c*), switching unit 2', capacitors 3' (3'*a* to 3'*c*), oscillation unit 4', detection unit 5', A/D conversion unit 6', comparison judgment unit 7', memory 8', an input terminal (not shown), and an output terminal (not shown). Coils 1'*a* to 1'*c* have inductances made of coils L1, L2, L3 respectively, and switching unit 21 for selectively switching coils 1'*a* to 1'*c* is composed of P channel MOS-type FETs Tr1, Tr2, Tr3. Capacitors 3'*a*, 3'*b*, 3'*c* are capacitors having electrostatic capacity C2, and oscillation unit 4' comprises operation amplifier A1 which is connected to form an oscillation circuit having as circuit structure elements coil 1' (one of 1'*a* to 1'*c*) and capacitor 3' (any of 3'*a* to 3'*c* and corresponding to coils 1'*a* to 1*c*) connected in parallel to the coil 1' via switching unit 2'; CR series circuit of capacitor C1 and resistor R1 connected so to form a positive feedback circuit of operation amplifier A1; and resistors R2, R3 connected so to determine gain of operation amplifier A1. Detection unit 5' comprises a voltage doubler rectifier circuit consisting of diodes D1, D2, and an integration circuit consisting of resistor R4 and capacitor C4. A/D conversion unit 6', comparison judgment unit 7' and memory 8' are composed by MPU 40' to which interface terminal 41' and output terminal 42' are connected.

This coin detecting device 100' has capacitor 3, which is contained in oscillation unit 4 of coin detecting device 100 (see FIG. 1 and FIG. 4) in the first embodiment, as capacitor 3' in a number corresponding to the number of coils 1'. The capacitors 3' are connected in parallel with coils 1' at coin detecting positions, and a pair of coil 1' and capacitor 3' is selectively connected to oscillation unit 4' by switching unit 2' to detect a coin. Principle and operation of coin detection are the same as those of the coin detecting device 100 in the first embodiment and are omitted from being described.

In the embodiments described above, the coil shown in FIG. 2 is used to detect the coin, but another coil may be used to detect the coin.

Figure 9:
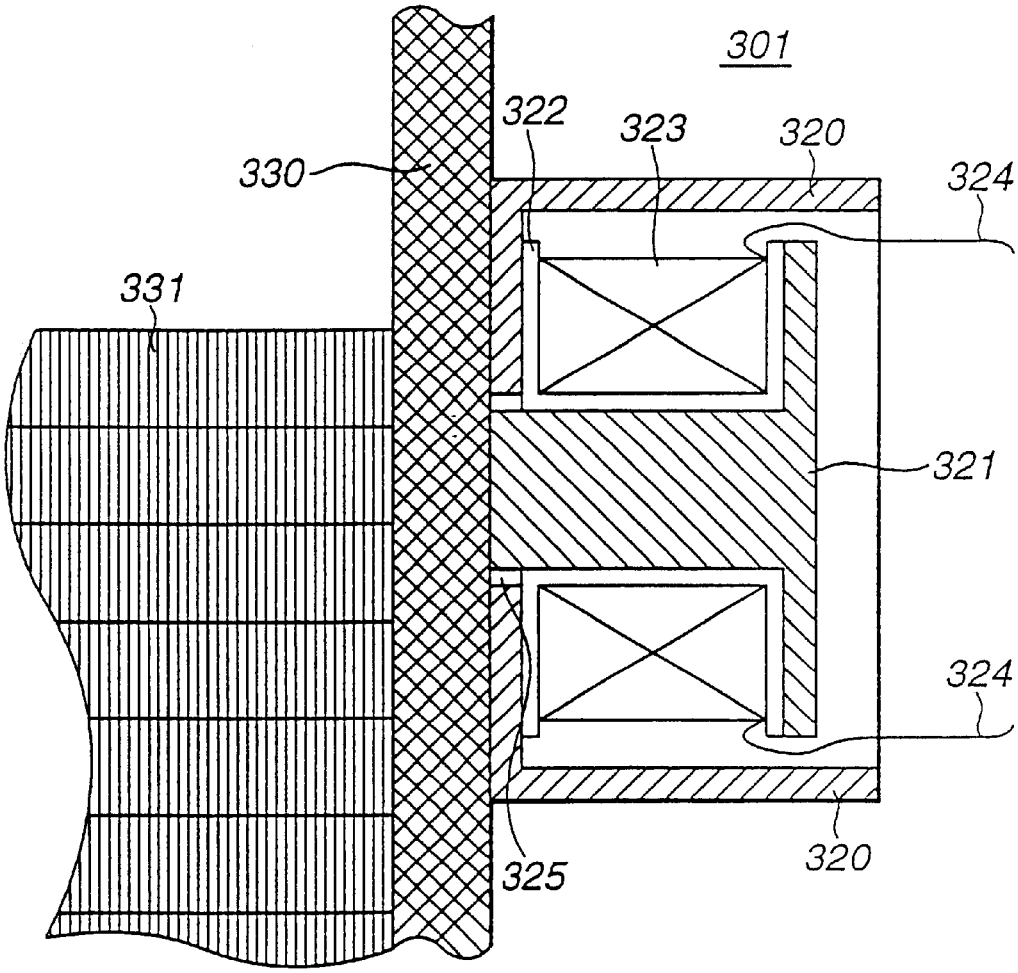
FIG. 9 is a diagram showing the structure of a coil different from the one shown in FIG. 2.

FIG. 9 is a diagram showing the structure of a coil different from the one shown in FIG. 2.

In FIG. 9, coil 301 comprises T-type ferrite core 321, bobbin 322 attached to ferrite core 321, coil 323 wound around bobbin 322 and lead 324 and is housed in casing 320. Hole 325 corresponding to a diameter of T-type ferrite core 321 is formed on casing 320, and ferrite core 321 is protruded from hole 325. Coil 301 is disposed in coin storing unit 330 (FIG. 9 corresponds to FIG. 3) to detect that coins 331 are accumulated.

Coil 301 has better sensitivity of Q compared with coil 1 shown in FIG. 2 because ferrite core 321 is protruded from casing 320.

Figure 10:
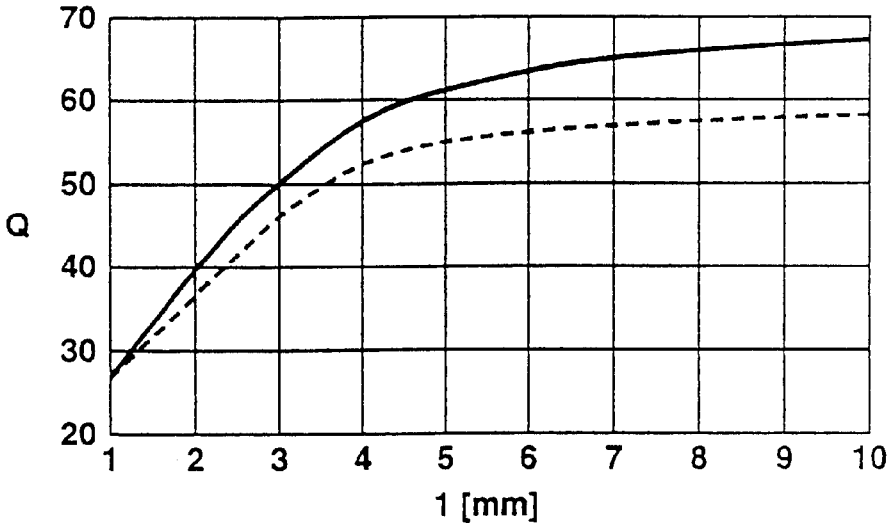
FIG. 10 is a diagram showing a comparison between coil 1 and coil 301 for Q.

FIG. 10 is a diagram showing an example of comparison between coil 1 and coil 301 for Q.

In the drawing, a broken line shows a relation between Q of coil 1 and coin-to-coil distance 1 in a certain condition, and a solid line shows a relation between Q of coil 301 and coin-to-coil distance 1 in the same condition (materials of coil and ferrite core, temperatures and others).

It is seen from FIG. 10 that coil 301 having ferrite core 321 protruded from casing 320 tends to have better Q as compared with coil 1. Coin detecting sensitivity can be improved by using coil 301.

Where hole 325 is formed on casing 320 as coil 301, it is hard to make potting of the coil with a liquid, and an effect of dirt prevention may also be lowered. It is also seen from FIG. 10 that when housed in airtight casing 20 as coil 1 is, sensitivity of Q is improved when a distance to the coin becomes short. Therefore, when the coil is housed in the airtight casing, sensitivity of Q can be improved by making a coil-coin distance short.

Figure 11:
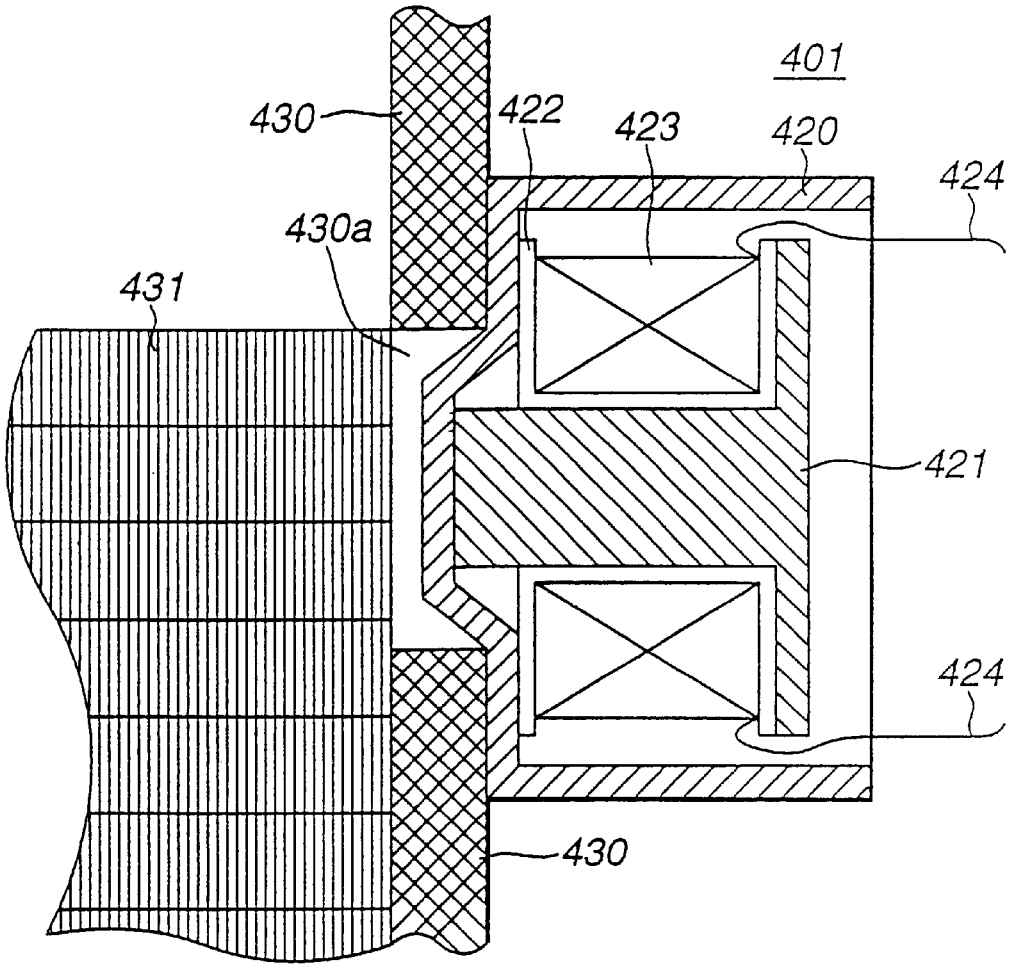
FIG. 11 is a diagram showing an example of the coil with Q improved.

FIG. 11 is a diagram showing an example of coil having improved Q.

In FIG. 11, coil 401 comprises T-type ferrite core 421, bobbin 422 mounted on ferrite core 421, coil 423 wound around bobbin 422, and lead 424. And ferrite core 421 is protruded from bobbin 422. Coil 401 is housed in airtight casing 420 which contains protruded ferrite core 421.

Casing 420 has a partly protruded shape because coil 401 has ferrite core 421 protruded. Therefore, hole 430*a* is formed on coin storing unit 430 where coil 401 is fitted. And coil 401 is mounted so to insert the protruded part of casing 420 into hole 430*a*.

By configuring as described above, a distance between coil 401 and coin 431 is made short as compared with coil 1 shown in FIG. 2, and sensitivity of Q can be improved.

In the embodiments described above, detection of the presence of coins in the coin storing unit by the coin processor was described. And a coil may also be disposed near the coin passage to detect that a coin has passed through the passage. In addition to the T-type ferrite core, the coil type may use a pot-type core, and the core unit in a coil using various forms of cores can be protruded to improve sensitivity.

INDUSTRIAL APPLICABILITY

The invention relates to a method and device to detect coins, which is configured to selectively connect one of a plurality of coils to an oscillation unit by a switch and to detect the presence of coins based on output from an oscillation circuit comprising the connected coil and the oscillation unit. By configuring as described above, mutual interference among the plurality of coils can be eliminated, and adjustments such as temperature correction can be made with ease.

Different types of coins can be detected and detection accuracy can be improved by changing a predetermined value to be compared with output from the oscillation circuit when the coil is switched.

Furthermore, adjustment of the oscillation circuit and the like is not required but a switch is additionally mounted when the number of coils is increased to detect coins. Therefore, the same circuit can be used for a variety of usage.

What is claimed is:

1. A method of detecting a coin, comprising the steps of:

arranging coils corresponding to a plurality of coin detecting positions;

selectively connecting the plurality of coils to an oscillation circuit which has the coils as circuit structure elements; and detecting coins to be detected at the plurality of coin detecting positions in view of a change in an oscillation output from the oscillation circuit as the coins to be detected approach the coils, wherein the oscillation circuit contains a positive feedback type amplifier and a capacitor and oscillates by connecting the coil with the capacitor in parallel, and a frequency of the oscillation is a resonance frequency of the oscillation circuit.

2. The method of detecting a coin according to claim 1, wherein the plurality of coils are sequentially switched to connect to the oscillation circuit.

3. The method of detecting a coin according to claim 1, wherein the oscillation output is converted into a digital signal, the converted digital signal is compared with a predetermined value, and the coins to be detected are detected based on the comparison result.

4. The method of detecting a coin according to claim 3, wherein the predetermined value is switched according to the coil to be connected.

5. The method of detecting a coin according to claim 1, wherein the change in the oscillation output is a change in the output level of the oscillation circuit.

6. The method of detecting a coin according to claim 1, wherein the change in the oscillation output is a stop of the oscillation of the oscillation circuit.

7. The method of detecting a coin according to claim 1, wherein the oscillation circuit comprises an amplifier which has positive feedback with a resistor and a first capacitor connected in series and a second capacitor and oscillates by connecting the coil to the second capacitor in parallel, and the frequency of the oscillation is a frequency based on an amplification factor of the amplifier and a resonance frequency of the positive feedback and the oscillation circuit.

8. The method of detecting a coin according to claim 1, wherein the coil is arranged together with the capacitor connected to the coil in parallel, and the coil and the capacitor are selectively connected with the oscillation circuit.

9. The method of detecting a coin according to claim 1, wherein the coil is wound around a core having a magnetic core and the core is protruded from the coil.

10. The method of detecting a coin according to claim 9, wherein the coil is housed together with the core in a predetermined casing.

11. A coin detecting device comprising:

a plurality of coils arranged to correspond with a plurality of coin detecting positions;

an oscillation circuit which selectively has one of the plurality of coils as a circuit structure element;

switching means for selectively connecting the plurality of coils to the oscillation circuit; and detection means for detecting coins to be detected at the plurality of coin detecting positions in view of a change in an oscillation output of the oscillation circuit as the coins to be detected approach the coils, wherein the oscillation circuit has a positive feedback type amplifier and a capacitor and oscillates when the coil is connected with the capacitor in parallel.

12. The coin detecting device according to claim 11, wherein the switching means sequentially switches the plurality of coils to connect to the oscillation circuit.

13. The coin detecting device according to claim 11, wherein the detection means comprises:

digital conversion means for converting the output from the oscillation circuit into a digital signal;

storage means for storing a fixed value; and comparison means for comparing a value of the digital signal converted by the digital conversion means with the fixed value stored in the storage means.

14. The coin detecting device according to claim 13, wherein the storage means outputs the fixed value corresponding to the coil connected by the switching means to the comparison means.

15. The coin detecting device according to claim 11, wherein the detection means detects a change in an output level of the oscillation circuit.

16. The coin detecting device according to claim 11, wherein the detection means detects that the oscillation circuit has stopped oscillating.

17. The coin detecting device according to claim 11, wherein the oscillation circuit comprises an amplifier which has positive feedback with a resistor and a first capacitor connected in series and a second capacitor, and oscillates when the coil is connected to the second capacitor in parallel.

18. The coin detecting device according to claim 11, wherein the coil is arranged together with a capacitor which is connected to the coil in parallel, and the switching means selectively connects the coil together with the capacitor to the oscillation circuit.

19. The coin detecting device according to claim 11, wherein the coil is wound around a core having a magnetic core, and the core is protruded from the coil.

20. The coin detecting device according to claim 19, wherein the coil is housed together with the core in a predetermined casing.

* * * * *